US006091436A

United States Patent [19]

Kuwabara

[11] Patent Number: 6,091,436

[45] Date of Patent: Jul. 18, 2000

[54] METHOD OF CORRECTING UNEVEN DENSITIES IN THERMAL RECORDING APPARATUS

[75] Inventor: Takao Kuwabara, Kanagawa, Japan

[73] Assignee: Fuji Photo Film Co., Ltd., Kanagawa, Japan

[21] Appl. No.: 08/889,567

[22] Filed: Jul. 8, 1997

[30] Foreign Application Priority Data

Jul. 8, 1996 [JP] Japan ..... 8-178129

[51] Int. Cl.[7] ..... B41J 2/36

[52] U.S. Cl. ..... 347/195; 400/120.15

[58] Field of Search ..... 347/188, 195, 347/190; 400/120.09, 120.1, 120.15

[56] References Cited

U.S. PATENT DOCUMENTS

| | | | |
|---|---|---|---|
| 4,879,566 | 11/1989 | Hanabusa . | |
| 5,235,346 | 8/1993 | Yeung | 400/120.09 |
| 5,451,984 | 9/1995 | Takamiya et al. | 347/217 |
| 5,677,721 | 10/1997 | Suzuki et al. | 347/190 |
| 5,886,724 | 3/1999 | Kuwabara et al. | 347/188 |

FOREIGN PATENT DOCUMENTS

| | | | |
|---|---|---|---|
| 0213934 | 3/1987 | European Pat. Off. | B41J 25/30 |
| 0431621 | 6/1991 | European Pat. Off. | B41J 2/325 |
| 402263664A | 10/1990 | Japan | B41J 2/36 |
| 403036053A | 2/1991 | Japan | B41J 2/36 |
| 408080632A | 3/1996 | Japan | B41J 2/36 |

*Primary Examiner*—N. Le
*Assistant Examiner*—Shin-wen Hsieh
*Attorney, Agent, or Firm*—Sughrue, Mion, Zinn, Macpeak & Seas, PLLC

[57] ABSTRACT

According to the improved method of correcting uneven densities in a thermal recording apparatus, on the basis of a preliminarily computed mathematical function that represents the relationship between the image data and the frictional force between the thermal recording material and the thermal head, a total sum of functional values corresponding to the image data of individual pixels in a present line, as well as a total sum of functional values corresponding to the image data of individual pixels in a preceding line are taken and the image data are corrected in accordance with the difference between the two total sums. This method can prevent effectively the occurrence of uneven densities due to the variation of recording density to provide for precise image recording.

4 Claims, 5 Drawing Sheets

METHOD OF CORRECTING UNEVEN DENSITIES IN THERMAL RECORDING APPARATUS

BACKGROUND OF THE INVENTION

This invention relates to a method of correcting uneven densities that occur in the image being recorded on a thermal recording material (hereunder referred to as a "thermal material") with a thermal recording apparatus in association with image data.

Thermal materials such as thermal films comprising a thermal recording layer on a film substrate are commonly used to record images produced in diagnosis by ultrasonic scanning. This recording method eliminates the need for wet processing and offers several advantages including convenience in handling. Hence in recent years, the use of the thermal recording system is not limited to s mall-scale applications such as diagnosis by ultrasonic scanning and an extension to those areas of medical diagnoses such as CT, MRI and X-ray photography where large and high-quality images are required is under review.

As is well known, the thermal recording apparatus uses a thermal head having a glaze in which heat generating resistors corresponding to the number of pixels in one line are arranged in one direction and, with the glaze a little pressed against the thermal recording layer of the thermal material, the thermal material is transported for example by transport means such as a transport roller to be relatively moved in a direction approximately perpendicular to the direction in which the heat generating resistors are arranged, and the respective heat generating resistors of the glaze are heated in accordance with the image data to be recorded to heat the thermal recording layer of the thermal material, thereby accomplishing image reproduction.

In the thermal recording apparatus, the force of friction at the interface between the running thermal material and the thermal head changes in accordance with the density of the image being recorded on the thermal material. For example, depending on its characteristics, the thermal material is insufficiently melted on the surface during low-density recording that its surface is not in a highly slippery condition. On the other hand, during high-density recording, the surface of the thermal material is sufficiently melted to become highly slippery.

As a result, at the boundary between two areas of the thermal material where the recording density experiences an abrupt increase, namely, at the transition of the surface of the thermal material from the less slippery state to a slippery state, the transport speed of the thermal material increases momentarily and only the recording density in the transition area will drop to cause unevenness in density in the form of white streaks. Conversely, at the transition from the slippery to a less slippery state, the transport speed slows down momentarily to cause unevenness in density in the form of black streaks.

This problem is discussed below in a more specific way.

FIG. 9 shows conceptually an example of the image being recorded. As shown, the image being recorded consists of a rectangular high-density area in the center of the thermal material and the surrounding low-density area. If the thermal material is transported in the direction of an arrow, the low-density area in the lower part of FIG. 9 is first recorded, then the central high-density area is recorded and finally the low-density area in the upper part is recorded.

The transport rollers, or rollers for transporting the thermal material are controlled by a transport motor such that the thermal material is transported at a constant speed at all times; however, as already mentioned, the force of friction between the thermal material and the thermal head will vary with the recording density, causing a change in the torque of the transport motor that is required to transport the thermal material. A comparatively large transport torque is required when the surface of the thermal material is less slippery but a comparatively small transport torque will suffice if the surface of the thermal material is slippery.

The transport rollers on the thermal recording apparatus are usually made of rubber and the shape of rubber rollers is deformed in response to the change in the transport torque. Briefly, the greater the transport torque, the more deformed the rubber rollers will be. Hence, the rubber rollers are deformed abruptly when recording is done at the transition from the area of small transport torque to the area of large torque; conversely, the rubber rollers will revert to the initial shape abruptly when recording is done at the transition from the area of large transport torque to the area of small torque.

In the illustrated case, if recording is done at the boundary between two areas of the thermal material where there is a transition from the low-density area in the lower part of FIG. 9 to the central high-density area, the transport torque decreases abruptly, whereupon the greatly deformed rubber rollers will revert to the initial shape so that the transport speed of the thermal material increases momentarily to lower the recording density, thereby producing a white line across the thermal material in a direction perpendicular to the direction of its transport. Conversely, a black line will develop if recording is done at the boundary where there is a transition from the central high-density area of the thermal material to the low-density area in the upper part.

Rubber rollers are used as the transport rollers in order to ensure that the thermal material being transported is depressed sufficiently uniformly to improve the precision in its transport, thereby producing a recorded image of high quality. Non-rubber rollers such as metal rollers are incapable of depressing the thermal material uniformly in the presence of slight distortions, hence failing to transport the thermal material in high precision. On the other hand, the use of rubber rollers has a limitation in that no matter how much improved the transport motor is in terms of performance, the image being recorded will experience the aforementioned unevenness in density.

Thus, the prior art thermal recording apparatus has had the problem that depending on the constituent material of the means for transporting the thermal material, uneven densities occur at density changing boundaries in response to the change in transport torque on account of the variation in recording density.

This reduction in the precision of image recording results in the deterioration of the quality of finished images and, particularly in medical areas where high-quality images need be recorded, the defect can potentially cause a serious problem by leading to a wrong diagnosis.

SUMMARY OF THE INVENTION

The present invention has been accomplished under these circumstances and has as an object providing a method of correcting uneven densities in thermal recording apparatus by ensuring that no uneven densities due to the variation in recording density will occur at boundaries where the recording density makes a transition from low to high value and vice versa.

To achieve the above object, the invention provides a method of correcting uneven densities in a thermal recording apparatus with which an image corresponding to image data is formed on a thermal recording material using a thermal head, wherein on the basis of a preliminarily computed mathematical function that represents the relationship between said image data and the frictional force between said thermal recording material and said thermal head, a total sum of functional values corresponding to the image data of individual pixels in a present line, as well as a total sum of functional values corresponding to the image data of individual pixels in a preceding line are taken and wherein said image data are corrected in accordance with the difference between said two total sums.

It is preferred that said mathematical function representing the relationship between said image data and the frictional force between said thermal recording material and said thermal head is approximated by a linear function and that a total sum of image data values corresponding to said image data is taken in place of said functional values corresponding to said image data.

The invention also provides a method of correcting uneven densities in a thermal recording apparatus with which an image corresponding to image data is formed on a thermal recording material using a thermal head, wherein on the basis of a preliminarily computed mathematical function that represents the relationship between said image data and the frictional force between said thermal recording material and said thermal head and also on the basis of another preliminarily computed mathematical function that represents the relationship between said frictional force and the amount of deformation of rubber rollers between which said thermal recording material is held for transport, an amount of change in the rubber roller's deformation is determined for the position of each pixel in each line and said image data for a present line are corrected in accordance with the amount of change in said rubber roller's deformation for the position of each pixel in the present line and the correction coefficient for a preceding line.

It is preferred that the amount of change in said rubber roller's deformation for the position of each pixel in the present line is replaced by the sum of the mean average of changes in the amount of roller deformation for each line and the mean average of changes in the amount of roller deformation for a total of m pixels including a pixel of interest, as determined for the position of each pixel in each line.

DETAILED DESCRIPTION OF THE INVENTION

The method of correcting uneven densities in thermal recording apparatus according to the invention will now be described in detail with reference to the preferred embodiments shown in the accompanying drawings.

Figure 1:
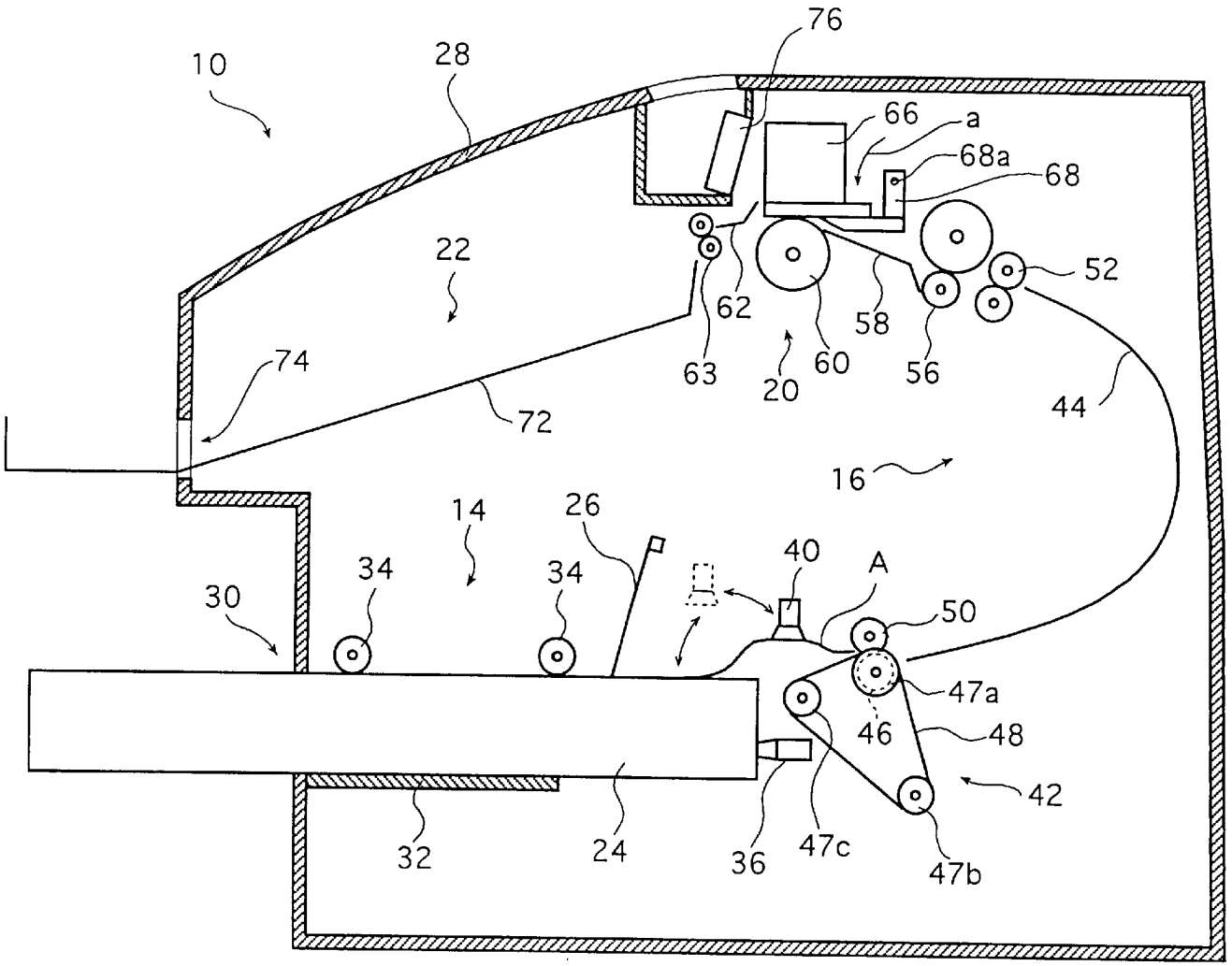
FIG. 1 is a diagram showing the concept of an embodiment of thermal recording apparatus to which the present invention may be applied.

FIG. 1 shows schematically an embodiment of the thermal recording apparatus to which the method of correcting uneven densities of the invention is applied.

The thermal recording apparatus generally indicated by 10 in FIG. 1 and which is hereunder simply referred to as a "recording apparatus 10" performs thermal recording on thermal films of a given size, say, B4 (namely, thermal films in the form of cut sheets). The apparatus comprises a loading section 14 where a magazine 24 containing thermal films A is loaded, a feed/transport section 16, a recording section 20 performing thermal recording on thermal films A by means of the thermal head 66, and an ejecting section 22.

The thermal films A comprise respectively a substrate consisting of a transparent film such as a transparent polyethylene terephthalate (PET) film, which is overlaid with a thermal recording layer. Typically, such thermal films A are stacked in a specified number, say, 100 to form a bundle, which is either wrapped in a bag or bound with a band to provide a package. As shown, the specified number of thermal films A bundled together with the thermal recording layer side facing down are accommodated in the magazine 24 of the recording apparatus 10, and they are taken out of the magazine 24 one by one to be used for thermal recording.

The loading section 14 has an inlet 30 formed in the housing 28 of the recording apparatus 10, a guide plate 32, guide rolls 34 and a stop member 36.

The magazine 24 is a case having a cover 26 which can be freely opened, and is inserted into the recording apparatus 10 via the inlet 30 of the loading section 14 in such a way that the portion fitted with the cover 26 is coming first; thereafter, the magazine 24 as it is guided by the guide plate 32 and the guide rolls 34 is pushed until it contacts the stop member 36, whereupon it is loaded at a specified position in the recording apparatus 10.

The feed/transport section 16 has the sheet feeding mechanism using the sucker 40 for grabbing the thermal film A by application of suction, transport means 42, a transport guide 44 and a regulating roller pair 52 located in the outlet of the transport guide 44; the thermal films A are taken out of the magazine 24 in the loading section 14 and transported to the recording section 20.

The transport means 42 is composed of a transport roller 46, a pulley 47*a* coaxial with the transport roller 46, a pulley 47*b* coupled to a rotating drive source, a tension pulley 47*c*, an endless belt 48 stretched between the three pulleys 47*a*, 47*b* and 47*c*, and a nip roller 50 that is to be pressed onto the transport roller 46.

When a signal for the start of recording is issued, the cover 26 is opened by the OPEN/CLOSE mechanism (not shown) in the recording apparatus 10. Then, the sheet feeding mechanism using the sucker 40 picks up one sheet of thermal film A from the magazine 24 and feeds the forward end of the sheet to the transport means 42 (to the nip between rollers 46 and 50).

At the point of time when the thermal film A has been pinched between the transport roller 46 and the nip roller 50, the sucker 40 releases the film, and the thus fed thermal film A is supplied along the transport guide 44.

At the point of time when the thermal film A to be used in recording has been completely ejected from the magazine 24, the OPEN/CLOSE mechanism closes the cover 26. The distance between the transport means 42 and the regulating roller pair 52 which is defined by the transport guide 44 is set to be somewhat shorter than the length of the thermal film A in the direction of its transport The advancing end of the thermal film A first reaches the regulating roller pair 52 by the transport means 42. The regulating roller pair 52 are normally at rest. The advancing end of the thermal film A stops here.

When the advancing end of the thermal film A reaches the regulating roller pair 52, the temperature of the thermal head 66 is checked and if it is at a specified level, the regulating roller pair 52 start to transport the thermal film A, which is trans ported to the recording section 20.

Figure 2:
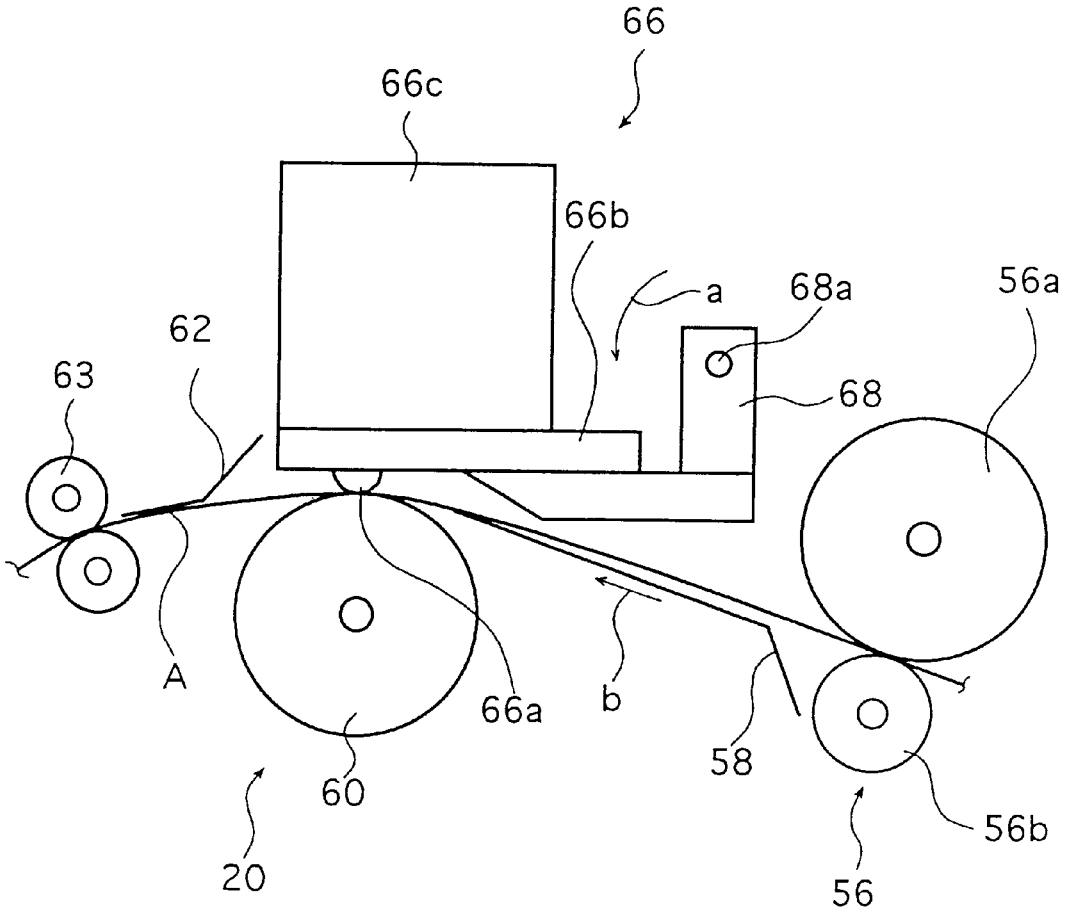
FIG. 2 is a diagram showing the concept of an embodiment of the recording section of the thermal recording apparatus shown in FIG. 1.

FIG. 2 shows schematically the recording section 20.

As shown, the recording section 20 has the thermal head 66, a platen roller 60, a cleaning roller pair 56, a guide 58, a fan 76 for cooling the thermal head 66 (see FIG. 1, not shown in FIG. 2), a guide 62, and a transport roller pair 63.

As shown, the thermal head 66 is capable of thermal recording at a recording (pixel) density of, say, about 300 dpi on thermal films for example up to a maximum of B4 size. The head comprises a thermal head body 66*b* having a glaze 66*a* in which the heat generating resistors performing one line thermal recording on the thermal film A are arranged in one direction (perpendicular to the paper of FIG. 2), and a heat sink 66*c* fixed to the thermal head body 66*b*. The thermal head 66 is supported on a support member 68 that can pivot about a fulcrum 68*a* either in the direction of arrow a or in the reverse direction.

The platen roller 60 rotates at a specified image recording speed while holding the thermal film A in a specified position, and transports the thermal film A in the direction (direction of arrow b in FIG. 2) approximately perpendicular to the direction in which the glaze 66*a* extends.

The cleaning roller pair 56 comprises a sticky rubber roller 56*a* and a non-sticky roller 56*b*.

Before the thermal film A is transported to the recording section 20, the support member 68 has pivoted to UP position (in the direction opposite to the direction of arrow a) so that the glaze 66*a* of the thermal head 66 is not in contact with the platen roller 60.

When the transport of the thermal film A by the regulating roller pair 52 starts, said film A is subsequently pinched between the cleaning roller pair 56 and transported as it is guided by the guide 58.

When the advancing end of the thermal film A has reached the record START position (i.e., corresponding to the glaze 66*a*), the support member 68 pivots in the direction of arrow a and the thermal film A becomes pinched between the glaze 66*a* on the thermal head 66 and the platen roller 60 such that the glaze 66*a* is pressed onto the recording layer while the thermal film A is transported in the direction of arrow b by means of the platen roller 60, the regulating roller pair 52 and the transport roller pair 63 as it is held in a specified position by the platen roller 60.

During this transport, the individual heat generating resistors on the glaze 66*a* are actuated in accordance with the data of the image to be recorded to perform imagewise thermal recording on the thermal film A.

In the illustrated thermal recording apparatus, this operation of thermal recording in accordance with the data of the image to be recorded is performed by an image data processing system, which is described specifically below.

Figure 3:
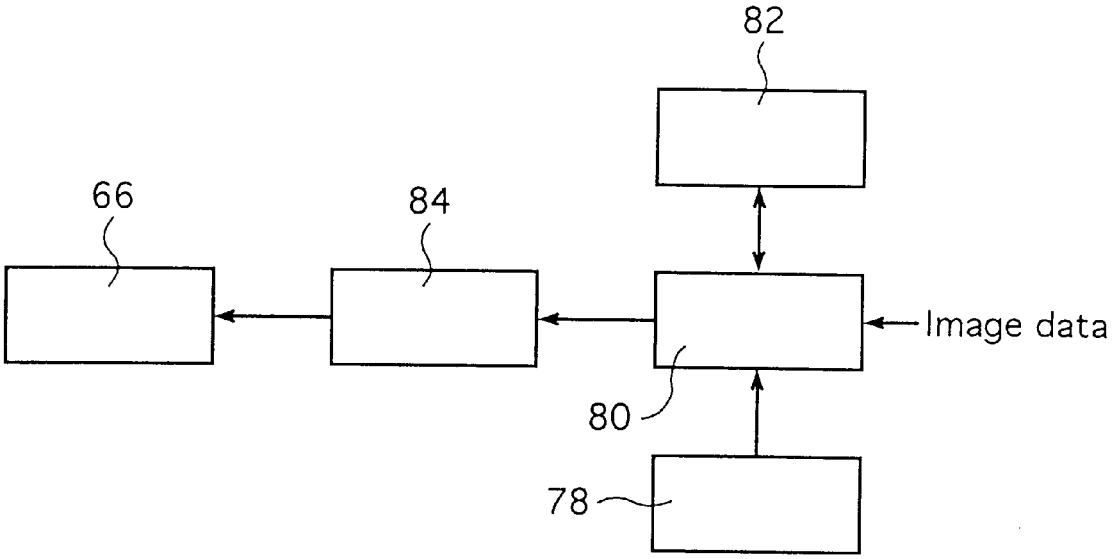
FIG. 3 is a diagram showing the concept of an embodiment of the image data processing system of the thermal recording apparatus to which the present invention may be applied.

FIG. 3 is a diagram showing the concept of an embodiment of the image data processing system. The illustrated system comprises a correction data storage unit 78 for holding various kinds of image data correcting data, an image processing unit 80 which performs various corrections (image processing) on the image data, an image memory 82 for holding the corrected image data, and a recording control unit 84 which controls the thermal head 66 on the basis of the image data held in the image memory 82.

Speaking first of the correction data storage unit 78, it holds various kinds of image data associated correction data, one of which is the data for correcting the uneven densities that occur at density changing boundaries in response to the change in transport torque on account of the variation in recording density (such uneven densities are hereunder referred to as "uneven densities or density unevenness due to the variation in recording density"); in a specific case, a computing equation, a lookup table or the like is stored as a mathematical function that represents the relationship between the image data and the force of friction between the thermal film A and the thermal head 66.

The data for correcting the uneven densities due to the variation in recording density, namely, a mathematical function that represents the relationship between the image data and the force of friction between the thermal film A and the thermal head 66 can typically be computed preliminarily by outputting a pattern of image data in which the recording density increases progressively and measuring the transport torque in the transport motor by a suitable means such as a torque meter. Thus, the force of friction between the thermal film A and the thermal head 66 may typically be represented by the transport torque of the transport motor for driving the transport rollers.

Figure 4:
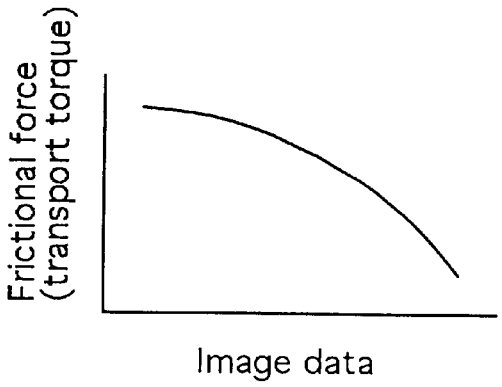
FIG. 4 is a graph showing an example of the data for correcting uneven densities due to the variation in recording density by the method of the invention.

FIG. 4 is a graph showing an example of the data for correcting the uneven densities due to the variation in recording density. The horizontal axis of the graph plots the image data for the range of recording densities which are employed by the thermal recording apparatus 10, and the vertical axis plots the transport torque, or the image data associated force of friction between the thermal film A and the thermal head 66. The density of the image data increases toward the right end of the graph and decreases toward the left end; the higher the density of the image data, the more slippery is the surface of the thermal film A (i.e., the smaller the transport torque).

FIG. 4 shows the case where the data for correcting the density unevenness due to the variation in recording density are represented graphically as a function; however, this is not the sole case of implementing the method of the invention for correcting uneven densities in thermal recording apparatus and other expressions may of course be adopted, such as a functional formula which is a mathematical expression of the relationship between the image data and the force of friction between the thermal film A and the thermal head 66, and a lookup table which is a numerical expression of the same relationship.

Then, the image processing unit 80 is supplied with image data from an image supply source such as CT or MRI, and the density unevenness due to the variation in recording density is corrected on the basis of the function, such as the following computing equation, that is stored in the correction data storage unit 78:

$$D'_n(i) = (1 + k \times H_n) \times D_n(i) \quad (1)$$

$$H_n = \sum_{i=1}^{M} f(D_{n-1}(i)) - \sum_{i=1}^{M} f(D_n(i))$$

where n is a line number with the image to be recorded; i is a pixel number for the nth line; D'n(i) is the corrected image data value for the ith pixel at the nth line; Dn(i) is the yet to be corrected image data value for the ith pixel at the nth line; k is a correction coefficient; Hn is a quantitative measure of the change in the force of friction between the thermal film A and the thermal head 66 at the nth line; M is the total number of pixels in one line; and f(D) is a functional formula representing the relationship between the image data value D and the force of friction between the thermal film A and the thermal head 66.

According to the computing equation (1), the total sum of the frictional forces (transport torques) associated with the individual pixels on the present line is subtracted from the total sum of the frictional forces (transport torques) associated with the individual pixels on the preceding line on the basis of the function stored in the correction data storage unit 78 to thereby compute the amount of the change that occurred in frictional force between the preceding and the present line; then, the calculated change is multiplied by the correction coefficient such that the unevenness in the density of the image being recorded due to the variation in recording density is corrected for each of the pixels on each line.

Thus, for each of the lines in the image being recorded, the change in frictional force between the present and the preceding line, namely, the change in transport torque that occurs as the result of the shift from the preceding line to the present line, is calculated and each of the pixels in each line is corrected on the basis of the calculated amount of the change in transport torque, whereby the uneven densities that occur in the image being recorded on account of the variation in recording density can be compensated appropriately to accomplish highly precise image recording.

It should be noted that no such correction is made for the first line in the image being recorded. It should also be noted that during image recording, the force of friction between the thermal material and the thermal head varies with the characteristics and width of the thermal material, the diameter and length of transport rollers, etc. and that, therefore, if image recording is to be performed on a plurality of thermal materials as they are switched from one type to another, mathematical functions associated with the respective types of thermal material need be stored in the correction data storage unit 78 and, in addition, the functions need be updated whenever the design configuration of the apparatus is changed. If the force of friction between the thermal material and the thermal head varies in the case of color recording, for example, when recording respective colors such as Y, M and C, it is necessary to provide functions in association with the respective colors.

The computing equation (1) contains the correction coefficient k; therefore, if the relationship between the characteristics of various types of thermal material or the relationship between the characteristics of respective colors used in color recording can be dealt with by merely adjusting the correction coefficient k, in other words, if f'(D), or a function representing the relationship between the image data value D and the force of friction between a thermal material of a different type or color and the thermal head can be expressed as f'(D)=constant×f(D), there is no need to provide different functions for the respective types or colors and one only need adjust the value of the correction coefficient k.

Figure 5:
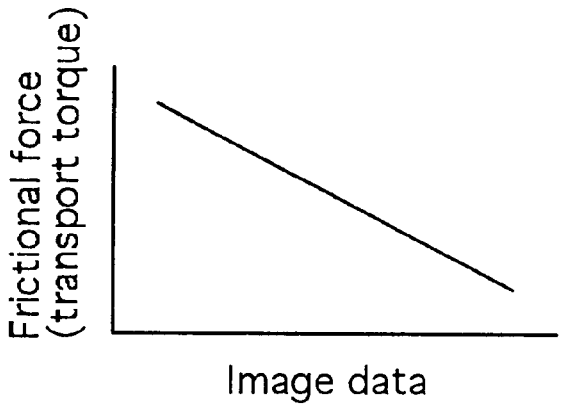
FIG. 5 is a graph showing another example of the data for correcting uneven densities due to the variation in recording density by the method of the invention.

FIG. 5 is a graph showing another example of the data for correcting the uneven densities due to the variation in recording density. The difference from the graph shown in FIG. 4 is that the relationship between the image data and the force of friction between the thermal material and the thermal head can be approximated by a linear function. As in FIG. 4, the horizontal axis of the graph plots the image data for the range of recording densities which are employed by the thermal recording apparatus 10, and the vertical axis plots the image data associated force of friction between the thermal film A and the thermal head.

If the relationship between the image data and the force of friction between the thermal material and the thermal head can be approximated by a linear function, there is no need to provide some form of mathematical function, such as a functional equation or a lookup table, that represents the relationship between the image data and the force of friction between the thermal material and the thermal head; instead, one may suffice to simply perform cumulative addition of the image data values for both the preceding and the present line and then take the difference between the two added values, as dictated by the computing equation set forth below, with the resulting advantage of faster processing speed:

$$D'_n(i) = (1 + k \times H_n) \times D_n(i)$$

$$H_n = \sum_{i=1}^{M} D_{n-1}(i) - \sum_{i=1}^{M} D_n(i)$$

As in Equation 1, n is a line number with the image to be recorded; i is a pixel number for the nth line; D'n(i) is the corrected image data value for the ith pixel at the nth line; Dn(i) is the yet to be corrected image data value for the ith pixel at the nth line; k is a correction coefficient; Hn is a quantitative measure of the change in the force of friction between the thermal film A and the thermal head at the nth line; and M is the total number of pixels in one line.

In addition to the correction o f the stated type of density unevenness, the image processing unit 80 performs various other kinds of image processing such as sharpness correction for enhancing the edge of the image, tone compensation for effecting correction in accordance with the tonal characteristics of the thermal film A, temperature compensation for adjusting the energy of heat generation in accordance with the temperature of heat generating resistors, resistance correction for correcting the difference between the resistances of adjacent heat generating resistors, black ratio compensation for correcting the unevenness in the image data of the same recording density that occurs due to the black ratio, and shading compensation for correcting the unevenness in recording density due to the thermal head 66; the corrected image data are then stored in the image memory 82.

Subsequently, on the basis of the corrected image data stored in the image memory 82, the recording control unit 84 controls the heat generation of the individual heat generating resistors that compose the glaze on the thermal head 66 and which have one-to-one correspondence to the respective pixels of one line and, as a result, a desired image is recorded.

After the end of thermal recording, the thermal film A as it is guided by the guide 62 is transported by the platen roller 60 and the transport roller pair 63 to be ejected into a tray 72 in the ejecting section 22. The tray 72 projects exterior to the recording apparatus 10 via the outlet 74 formed in the housing 28 and the thermal film A carrying the recorded image is ejected via the outlet 74 for takeout by the operator.

The recording apparatus 10 is basically as described above.

In the embodiment described above, the following three assumptions are made: the deformation of the rubber rollers is proportional to the force of friction between the thermal film A and the thermal head; the deformation is similar for all of the rubber rollers that are employed; and the change in the deformation of the rubber rollers ends within the one-line recording time in which the transport torque changed and no more effects are caused by the change to affect the recording density in subsequent lines. It is on the basis of these assumptions that the density unevenness which occurs in the image being recorded on account of the variation in recording density is effectively corrected for each of the pixels on each line in the image.

We now describe a modification of the embodiment, in which the correcting method of the invention is implemented taking into consideration the force of friction between the thermal film A and the thermal head as it relates to the amount of deformation of rubber rollers, as well as the deformation of such rubber rollers for the position of each of the pixels in each line, and also the temporal effect of the change in that deformation.

Figure 6:
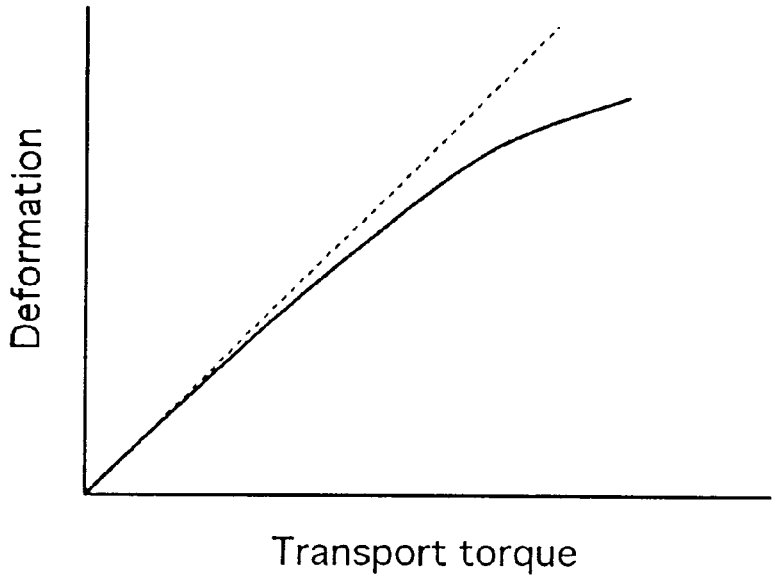
FIG. 6 is a graph showing yet another example of the data for correcting uneven densities due to the variation in recording density by the method of the invention.

FIG. 6 is a graph showing another example of the data for correcting the uneven densities due to the variation in recording density. The graph shows the force of friction between the thermal film A and the thermal head as it relates to the amount of deformation of rubber rollers. The horizontal axis of the graph plots the transport torque, or the force of friction between the thermal film A and the thermal head 66, and the vertical axis plots the deformation of rubber rollers as a function of the transport torque.

The amount of deformation of rubber rollers is variable with their constituent material, the magnitude of transport torque, etc. and may be approximated by an exponential function of (transport torque)$^P$. As the graph in FIG. 6 shows, the rubber rollers are deformed in response to the transport torque by amounts within a range delineated by a solid line (P=0.6) and a dashed line (P=1). Obviously, the dashed line (P=1) in FIG. 6 which shows the relationship between the transport torque and the deformation of rubber rollers represents the case where the force of friction between the thermal film A and the thermal head is proportional to the amount of roller deformation.

In t he modified embodiment of the invention, the possibility for the case where the force of friction between the thermal film A and the thermal head is not proportional to the amount of rubber roller's deformation is also taken into account and a mathematical function representing the relationship between transport torque and the amount of roller deformation is calculated preliminarily and stored in the correction data storage unit 78 in a suitable form such as a computing equation or a lookup table; on the basis of the stored function, the amount of roller deformation associated with the transport torque is computed by substituting Hn in Eq. (1) into the computing equation set forth below, whereby the correct amount of roller deformation can be calculated in association with the magnitude of transport torque:

$$H_n = \sum_{i=1}^{M} T(f(D_{n-1}(i))) - \sum_{i=1}^{M} T(f(D_n(i)))$$

Figure 7A:
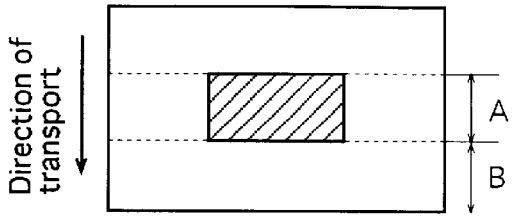
FIG. 7*a* is a graph showing the concept of an exemplary image being formed.
Figure 7B:
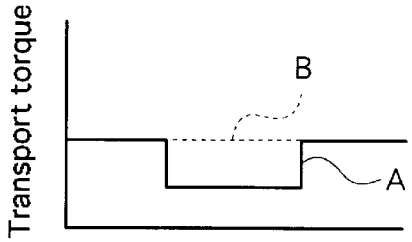
FIG. 7*b* is a graph showing the corresponding change in transport torque.
Figure 7C:
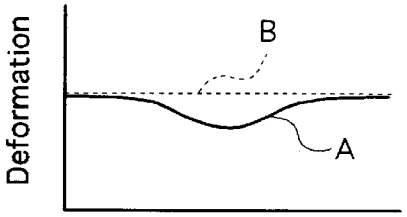
FIG. 7*c* is a graph showing the corresponding deformation of rubber transport rollers.
Figure 9:
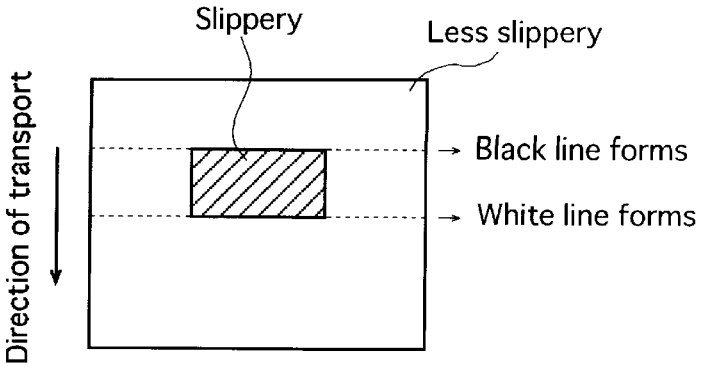
FIG. 9 is a diagram showing conceptually an example of the image being recorded.

FIG. 7*a* is a graph showing the concept of an exemplary image being formed; FIG. 7*b* is a graph showing the corresponding change in transport torque; and FIG. 7*c* is a graph showing the corresponding amount of deformation of rubber transport rollers. The image being recorded as shown in FIG. 7*a* is identical to the image shown in FIG. 9. Specifically, FIG. 7*b* shows the amount by which the transport torque changes in the positions of the individual pixels in the main scanning direction when regions A and B of the image shown in FIG. 7*a* are being formed; FIG. 7*c* shows the amount by which the rubber rollers deform in the positions of the individual pixels in the main scanning direction when the two regions are being formed.

Consider, for example, the case of recording an image as shown in FIG. 7*a*; depending on the characteristics of the thermal material, the high-density portion of region A (shaded in FIG. 7*a*) corresponds to the area where the temperature of the thermal head is sufficiently high that the surface of the thermal material is comparatively melted to become fairly slippery. In other words, the force of friction between the thermal film A and the thermal head is small and so is the transport torque. On the other hand, in the low-density portions of regions A and B, the force of friction between the thermal film A and the thermal head is increased and so is the transport torque.

Therefore, if region A of the image shown in FIG. 7*a* is to be recorded, the transport torque becomes comparatively small in the pixel positions corresponding to the high-density portion of region A, as the graph in FIG. 7*b* shows. Speaking of the deformation of the rubber rollers, it does not occur uniformly for every part of the rollers but differs from one pixel position to another; hence, in the embodiment under consideration, the amount of roller deformation varies, drawing a smooth curve in association with the high-density portion of region A, as the graph in FIG. 7*c* shows.

Hence, considering that the deformation of rubber rollers differs from one pixel position to another in the main scanning direction, the method of the invention bases on the two mathematical functions stored in the correction data storage unit 78, i.e., the function representing the relationship between the image data and the force of friction between the thermal film A and the thermal head 66, as well as the function representing the relationship between the transport torque and the amount of roller deformation, and may employ the computing equation set forth below in order to calculate the change in the amount of rubber deformation, dn(i), for each of the pixel positions in the main scanning direction:

$$dn(i)=T(f(D_{n-1}(i)))-T(f(D_n(i)))$$

where n is a line number with the image being recorded; i is a pixel number for the nth line; $D_n(i)$ is the image data value for the ith pixel at the nth (present) line; $D_{n-1}(i)$ is the image data value for the ith pixel at the (n−1)th (preceding) line; f(D) is the relation expressing the image data value and the magnitude of torque; and T(f) is a functional formula representing the force of friction between the thermal film A and the thermal head, as it relates to the amount of rubber roller's deformation.

Thus, as the graph in FIG. 7*b* shows, the amount of rubber roller's deformation that occurs in response to the change in transport torque for each of the pixel positions on each line in the image being recorded as shown in FIG. 7*a* can be computed for the position of each of the pixels on each line. On the basis of the computed amount of roller deformation, the propagation of the deformation to the surrounding pixels is calculated as shown in FIG. 7*c* and this can be accomplished by filtering, or a technique that represents a transfer function of deformation. In fact, however, the transfer of the deformation covers the entire length of the thermal head, so the filter length requires the total number of pixels, M, whereby a huge amount of calculations is necessary to determine the propagation of the deformation to the surrounding pixels.

Under the circumstances, the method of the invention assumes that FIG. 7*c* can be approximated by the addition of the mean average for the overall length of the graph in FIG. 7*b* to the mean average of deformations over short distances, and the unevenness in density that occurs in the image being recorded on account of the variation in recording density may be effectively corrected for each of the pixels on each line in accordance with the following procedure.

First, the computing equation set forth below may be adopted to calculate $\overline{dn}$, or the mean average of the changes in the amount of rubber roller's deformation in each line. In the following computing equation, M represents the total number of pixels in one line:

$$\overline{dn} = \frac{1}{M} \times \sum_{i=1}^{M} dn(i)$$

Then, one may employ the computing equation set forth below in order to compute, for each of the pixel positions on each line, $d_{nm}(i)$ or the average of the changes in the amount of rubber roller's deformation for a specified number (m) of pixels (e.g., m=500), with m/2=250 pixels being distributed both before and after the pixel position of interest:

$$d_{nm}(i) = \frac{1}{m} \times \sum_{i=i-\frac{m}{2}}^{i=\frac{m}{2}} d_n(i)$$

$$\text{where } d_n(i) = d_n(1)$$

$$\text{when } d_n\left(1 - \frac{m}{2}\right) \le d_n(i) \le d_n(0)$$

$$\text{and } d_n(i) = d_n(M)$$

$$\text{when } d_n(M+1) \le d_n(i) \le d_n\left(M + \frac{m}{2}\right)$$

Thus, the mean average ($\overline{d_n}$) of the changes in the amount of rubber roller's deformation is determined for each line and, in addition, the mean average ($d_{nm}(i)$) of the changes in the amount of roller deformation for a total of m pixels, with m/2 pixels being distributed both before and after the pixel of interest, is determined for each of the pixels in each line; thereafter, the two values of mean average are summed.

By this procedure, as the graph in FIG. 7*c* shows, the amount of rubber roller's deformation for each pixel position in each line on the image being recorded as shown in FIG. 7*a* can be computed for the position of each of the pixels on each line.

By taking into account the amount of rubber roller's deformation for each pixel position in each line, the invention offers the advantage of ensuring that the uneven densities which occur in the image being recorded on account of the variation in recording density can be corrected more precisely for each of the pixels in each line.

In the embodiment just discussed above, the mean average ($d_{nm}(i)$) of the changes in the amount of roller deformation for a total of m pixels, with m/2 pixels being distributed both before and after the pixel of interest, is determined for each of the pixels in each line, and the value of m may be determined as appropriate for a selected factor such as the characteristics of the rubber rollers. If the value of m is increased, one can construct a smooth curve of the profile shown in FIG. 7*c* for the amount of rubber roller's deformation; on the other hand, a huge amount of calculations are obviously required to determine $d_{nm}(i)$. Therefore, the exact value of m is preferably determined in consideration of the desired precision in computing the amount of roller deformation and the time required to do it.

Figure 8:
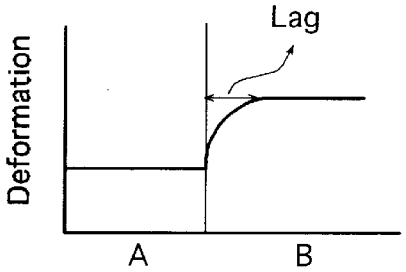
FIG. 8 is a graph showing how the deformation of rubber transport rollers changes in the invention method of correcting uneven densities in a thermal recording apparatus.

FIG. 8 is a graph showing how the deformation of rubber rollers changes at the boundary between regions A and B of the image being recorded as shown in FIG. 7*a*. Obviously, the change in the deformation of rubber rollers is not momentary but delayed in time and it sometimes occurs that the recording density is affected until two or three lines after the transport torque changed.

Hence, considering the temporal effects caused by the change in the amount of rubber roller's deformation, the method of the invention may employ the computing equation set forth below in order to compute a correction coefficient $d'_n(i)$ for each of the pixel positions in each line, thereby correcting the density unevenness in the image being recorded on account of the variation in recording density:

$$D'_n(i) = (1 + k \times d'_n(i)) \times D_n(i)$$

$$d'_n(i) = k_\alpha \times d'_{n-1}(i) + k_\beta \times d_i + d_m(i)$$

where $D'_n(i)$ is the corrected image data value for the ith pixel at the nth line; $D_n(i)$ is the yet to be corrected image data value for the ith pixel at the nth line; $d'_{n-1}(i)$ is a correction coefficient for each pixel at the preceding line; $k_\alpha$ and $k_\beta$ are constants.

Thus, the method of the invention for correcting uneven densities in a thermal recording apparatus is capable of correcting the density unevenness due to the variation in recording density by taking into account the force of friction between the thermal film A and the thermal head as it relates to the amount of rubber roller's deformation, as well as the deformation of such rubber rollers for the position of each of the pixels in each line, and also the temporal effect of the change in that deformation; as a result, the method provides for the recording of high-quality images with minimal unevenness in density.

The method of correcting uneven densities in thermal recording apparatus according to the invention is in no way limited to the above-stated embodiments and various improvements and modifications can of course be made without departing from the spirit and scope of the invention.

As described above in detail, the method of the invention for correcting density unevenness in a thermal recording apparatus computes the amount of a change in the force of friction between a thermal material and the thermal head for each line on the basis of a preliminarily calculated mathematical function which represents the relationship between the image data and the frictional force, and the image data for the present line are corrected in accordance with the difference between the changes in the frictional force for the preceding and the present line. In addition to said mathematical function representing the relationship between the image data and the force of friction between the thermal material and the thermal head, the invention method may also be based on a mathematical function which represents the relationship between said frictional force and the deformation of rubber rollers such as to determine the amount of a change in the roller deformation for the position of each of the pixels in each line and the image data for the present line are corrected in accordance with the amount of the change in roller deformation for the position of each of the pixels in the present line and the correction coefficient for the preceding line. In either way, the occurrence of uneven densities due to the variation of recording density can be effectively prevented to provide for precise image recording.

What is claimed is:

1. A method of correcting uneven densities in a thermal recording apparatus with which an image corresponding to image data is formed on a thermal recording material using a thermal head, comprising the steps of:

determining a difference between a total sum of frictional forces between said thermal recording material and said thermal head corresponding to the image data of individual pixels in a preceding line and a total sum of frictional forces between said thermal recording material and said thermal head corresponding to the image data of individual pixels in a present line, based on a mathematical function that represents the relationship between said image data and the frictional force between said thermal recording material and said thermal head; and correcting said image data in said present line based on the difference between said total sum of frictional forces in said preceding line and said total sum of frictional forces in said present line.

2. A method according to claim 1, wherein said mathematical function representing the relationship between said image data and the frictional force between said thermal recording material and said thermal head is approximated by a linear function and wherein said total sum of frictional forces between said thermal recording material and said thermal head is determined based on a total sum of image data values corresponding to said image data.

3. A method of correcting uneven densities in a thermal recording apparatus with which an image corresponding to image data is formed on a thermal recording material using a thermal head, comprising the steps of:

determining an amount of change of deformation of rubber rollers for a position of each pixel in each line; and correcting said image data for a present line in accordance with the amount of change of deformation of said rubber rollers for the position of each pixel in the present line and a correction coefficient for a preceding line, based on a mathematical function that represents the relationship between said image data and the frictional force between said thermal recording material and said thermal head and a mathematical function that represents the relationship between said frictional force and the amount of deformation of rubber rollers between which said thermal recording material is held for transport.

4. A method according to claim 3, wherein the amount of change in said rubber roller's deformation for the position of each pixel in the present line is replaced by the sum of a mean average of changes in the amount of roller deformation for each line and the mean average of changes in the amount of roller deformation for a total of m pixels including a pixel of interest, as determined for the position of each pixel in each line.

* * * * *